United States Patent [19]

Moskowitz

[11] Patent Number: 4,631,764

[45] Date of Patent: Dec. 30, 1986

[54] CONSOLE BED

[76] Inventor: Charles Moskowitz, 20400 NE. 15th Ct., Miami, Fla. 33179

[21] Appl. No.: 619,729

[22] Filed: Jun. 12, 1984

[51] Int. Cl.[4] ..... A47C 17/13; A47C 17/48; A47C 17/52

[52] U.S. Cl. ..... 5/150 B; 5/13; 5/29; 5/35; 5/159 R

[58] Field of Search ..... 5/13, 29, 136, 149, 5/150 R, 150 B, 35, 36, 28, 159 R

[56] References Cited

U.S. PATENT DOCUMENTS

| | | | |
|---|---|---|---|
| 2,999,250 | 9/1961 | Rea | 5/13 |
| 3,292,188 | 12/1966 | Gerth | 5/13 |
| 3,585,658 | 6/1971 | Spitz | 5/13 |
| 3,852,837 | 12/1974 | Eakins | 5/136 |
| 3,934,281 | 1/1976 | Brindisi | 5/13 |
| 4,200,941 | 5/1980 | Gill et al. | 5/13 |
| 4,301,559 | 11/1981 | Gernberghe | 5/13 |
| 4,399,571 | 8/1983 | Joyce | 5/13 |

FOREIGN PATENT DOCUMENTS

| | | |
|---|---|---|
| 39117 | 5/1892 | Canada . |
| 358100 | 5/1936 | Canada . |
| 586526 | 11/1959 | Canada . |
| 701525 | 1/1965 | Canada . |
| 12430 | 11/1984 | Canada . |

*Primary Examiner*—Alexander Grosz

[57] ABSTRACT

A collapsible bed is disclosed, foldable upright for storage in an article of furniture. The frame of the bed is formed of three connected longitudinal sections supported by three pairs of floor-engaging legs. The rear section is foldable over the middle section and the latter two sections are foldable over the front sections which can then be pivoted to an upright enclosed configuration in the article of furniture. Lock means are provided to prevent the collapsed frame from unfolding of its own accord.

8 Claims, 13 Drawing Figures

1
3
5
6
7
8
8'
10
11
11'
12
13
13'
14
15
16'
17
18
19
20
21
25
26'
27
28
33
36
37
38
39
50

CONSOLE BED

FIELD OF THE INVENTION

The present invention relates to collapsible beds, more specifically to a novel and improved bed which can be easily folded into a console type article of furniture.

BACKGROUND OF THE INVENTION

Collapsible beds are well known in the art. Designers of such beds have primarily kept in mind the need for a comfortable bed which can be folded to save needed floor space. Some of the well-known types of collapsible beds are the "sofa-beds", portable foldable beds and various foldable beds useful for camping purposes.

Till now all the above types of collapsible bed have had various disadvantages. Sofa beds tend to be very heavy and have relatively complicated folding mechanisms; portable beds are often lacking in aesthetic appearance, while the last-mentioned type can be relatively unstable and are in any case not suitable for home or apartment use.

OBJECTS OF THE INVENTION

In view of the above, it is a prime object of the present invention to provide a collapsible bed which has none of the above disadvantages and which can be easily and quickly folded uprightly in an integral article of furniture resembling a console or bureau.

Another object of the invention is to provide a collapsible bed of the type under consideration, which is non costly to manufacture.

SUMMARY OF THE INVENTION

In general, the invention is preferably embodied by an upright console having a pair of front doors hingedly secured at their respective vertical outer edges, such that they can be opened outwardly.

The console is completely enclosed and is adapted to contain a collapsible bed, preferably with a mattress, in vertically-folded configuration therein. Locking means are provided to releasably maintain the bed folded.

The bed comprises a rectangular frame defining an interior area which is strung with a deck of springs and a lattice of wire members according to any suitable construction known in the art.

The frame is formed of preferably three sections, which sections are pivotally longitudinally connected to one another through the intermediary of front and rear link members on each side of the frame. Both the front and rear link members comprise one element of a folding means for the frame at each juncture thereof.

Adjacent each link member and pivotally attached to the frame is a downwardly-extending leg on each side of the frame. Preferably, both transversely-aligned pairs of legs are joined together at their lower ends to form a unitary construction affording greater strength and stability.

Each leg is further pivotally secured to its mechanical folding means and is adapted to be pivoted upwardly outwardly along with the corresponding folding means, whereby the rear end section of the frame can be folded upwardly and then forwardly back onto the middle section in a generally spaced, parallel and overlying relationship with the latter. Similarly, the middle section can be then folded upwardly and forwardly onto the front section of the frame adjacent the console.

This front section also has a pair of legs and is mounted on the inner side walls of the console by a mounting means. The mounting means is adapted to permit the front section and the rear and middle sections folded thereover to be moved to an upright storage configuration completely contained by the console.

Further provided within the scope of the invention is a rigidity means to effectively prevent the two front and rear junctures from any movement in an upward vertical direction when the frame is unfolded in horizontal sleeping position.

Locking means are also integrated with the folding means to ensure that the folded sections of the frame will not open or unfold of their own accord or from pressure exerted by the folded mattress.

BRIEF DESCRIPTION OF THE DRAWINGS

The above will be more clearly understood by referring to the detailed description of the preferred embodiment and the annexed drawings, in which.

Like numerals indicate like elements throughout the drawings.

DETAILED DESCRIPTION OF THE PREFERRED EMBODIMENT

Figure 1:
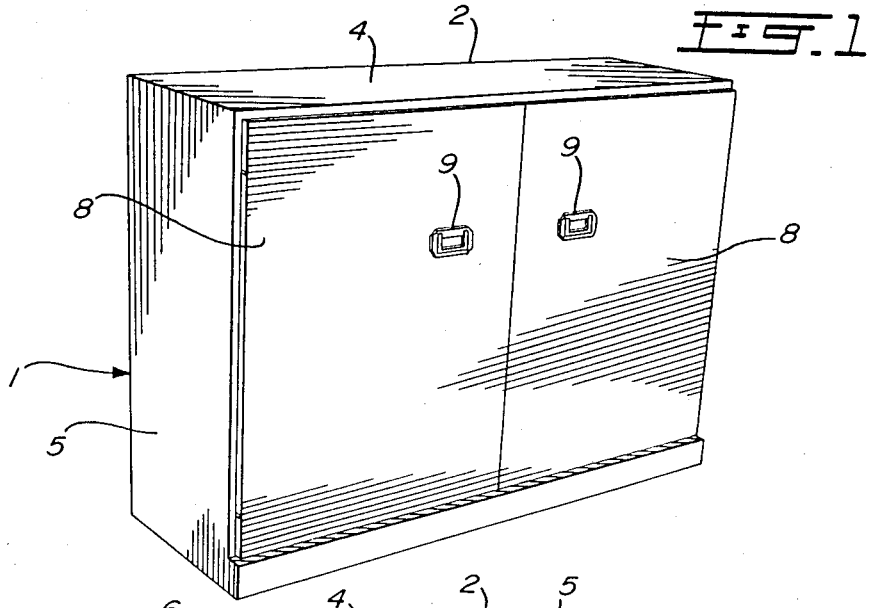
FIG. 1 is a perspective view of the console with the doors closed.
Figure 2:
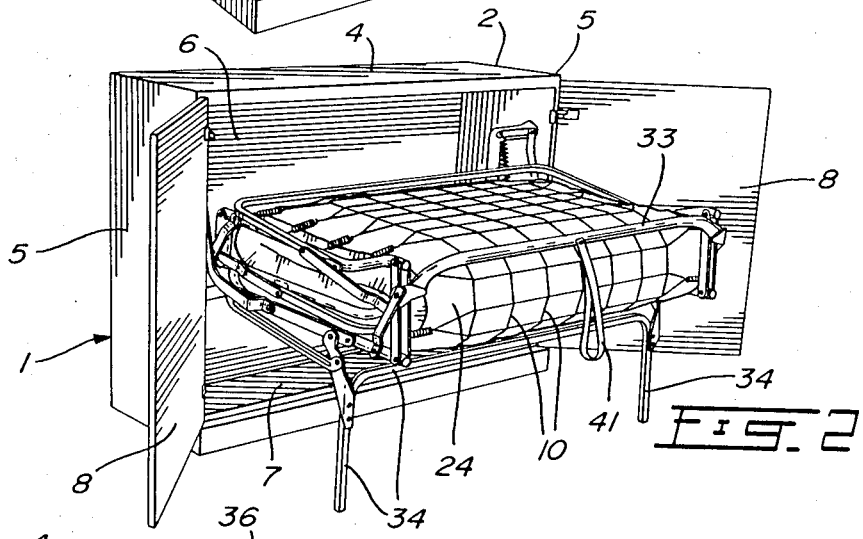
FIG. 2 is another perspective view of the console, showing the doors open and the bed in partially-unfolded configuration.

The console bed 1 of the invention includes a console or bureau 2 adapted to contain in folded configuration a bed frame 3.

Console 2 includes a top wall 4, a pair of opposite side walls 5, a back wall 6 and a bottom 7. The front of the console is provided with a pair of identical doors 8 hingedly secured to console 1 at their respective outer vertical edges 8' adjacent the front edges of side walls 5. Each door 8 has a central handle 9.

The bed 3 is formed of an elongated rectangular frame having a rear end and a front end nearest console 2. The interior area defined by the bed frame 3 is fitted with a lattice of link fabric and springs 10, as is known in the art.

Frame 3 has three separate sections: a rear section 11, a middle section 12 and a front section 13. These three sections are preferably of rigid tubular material which extends longitudinally in parallel spaced-apart relationship to form the sides of the frame. The sides of rear section 11 and front section 13 are joined by rear and front transverse members 11′ and 13′, respectively.

Rear section 11 and middle section 12 are joined together at both sides by a pair of relatively short link members 14. Each link 14 is of inverted U-shaped profile and is pivotally secured at its opposite ends 14′ and 14″ to the front end of rear section 11 and the rear end of middle section 12, respectively. Both links 14 are joined by a first rigid cross-piece 15 extending underneath the lattice 10.

Figure 6:
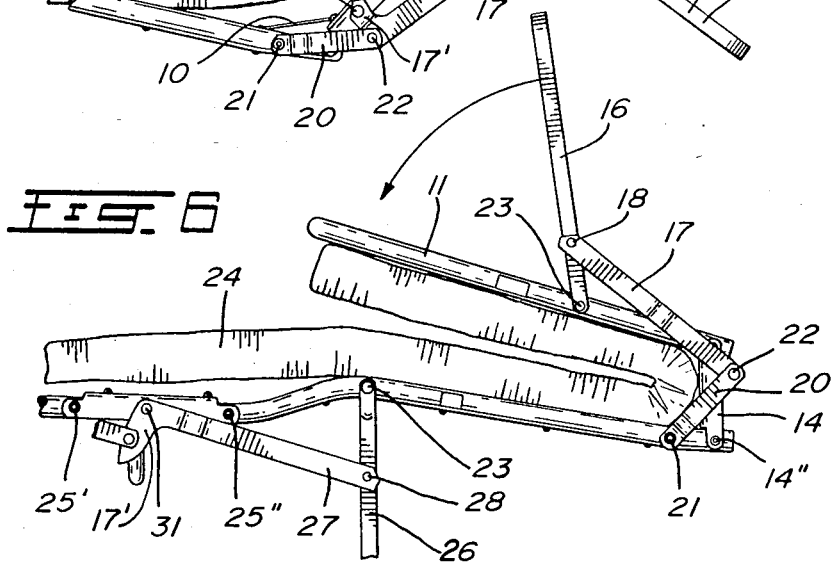
Figure 7:
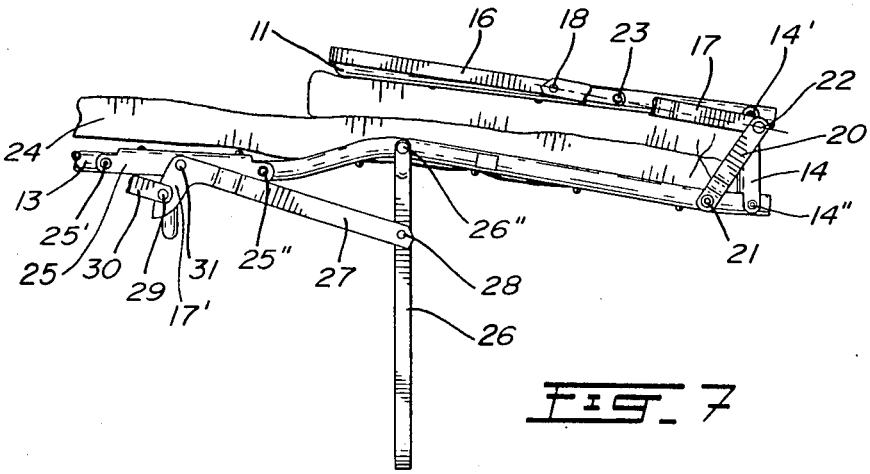
Figure 8:
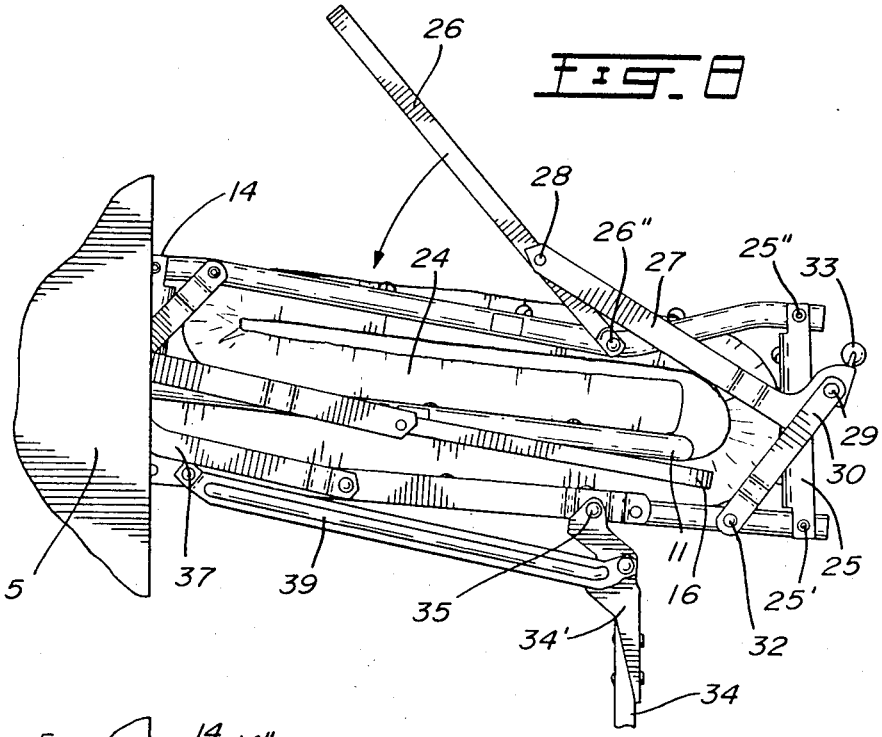
FIGS. 8 and 9 are also side elevations further showing how the middle and front sections are folded.
Figure 9:
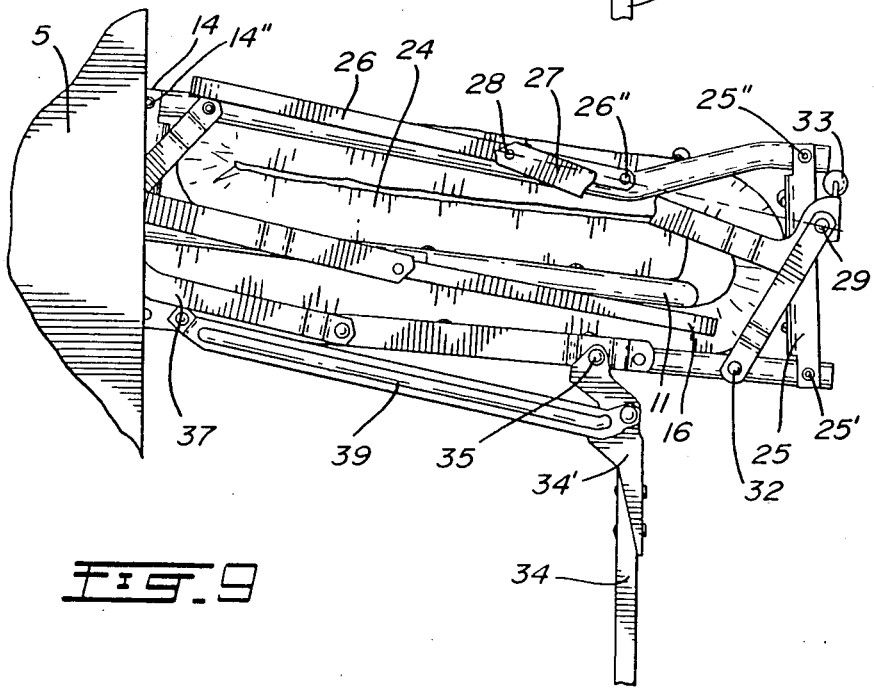
Figure 10:
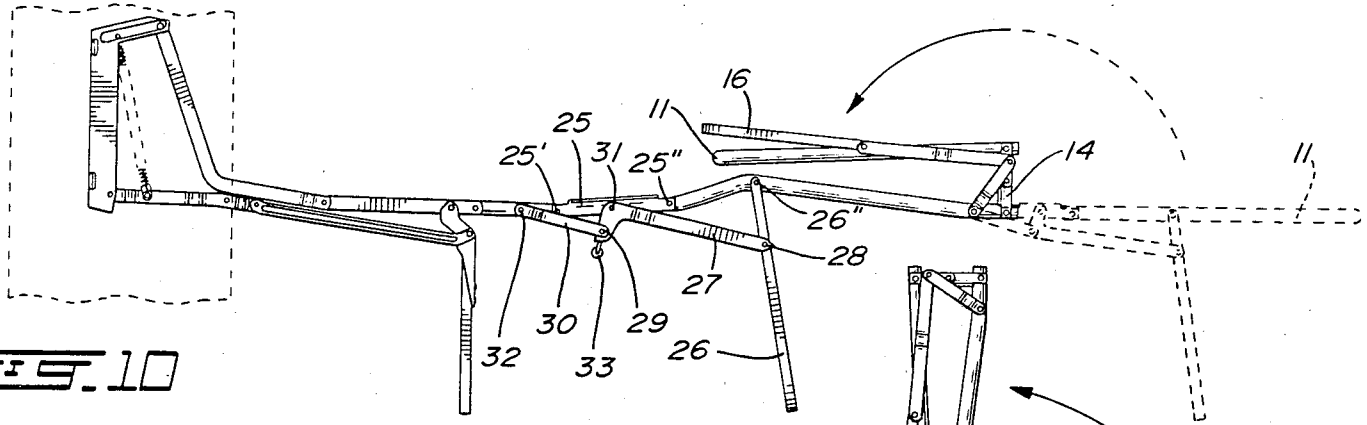
FIGS. 10 and 11 are side elevations of the bed showing the mounting means in the console and sequential folding of the frame.
Figure 11:
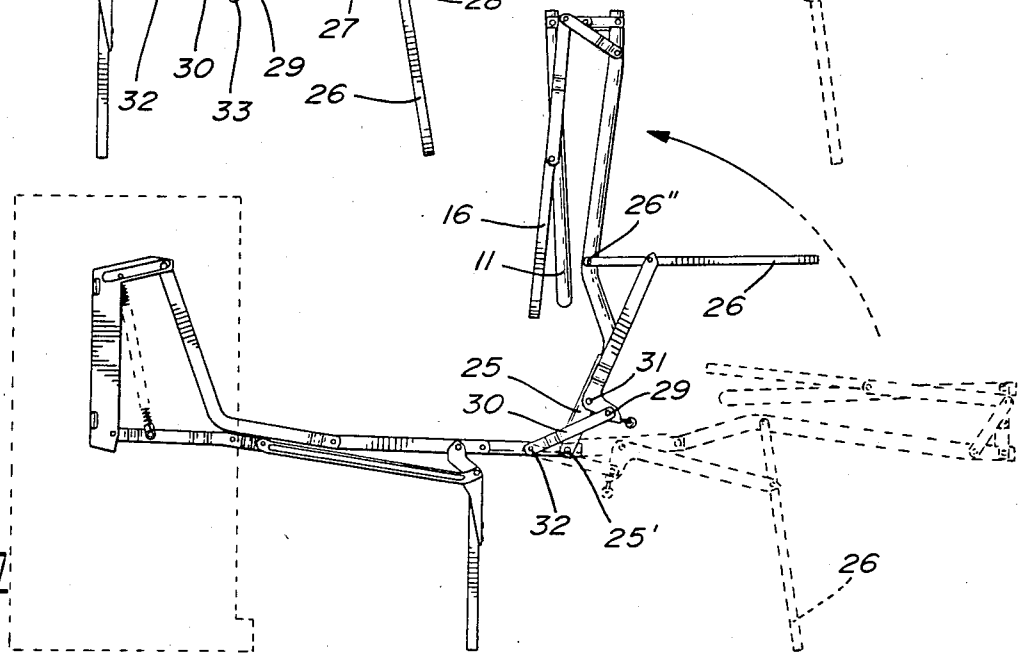
Figure 12:
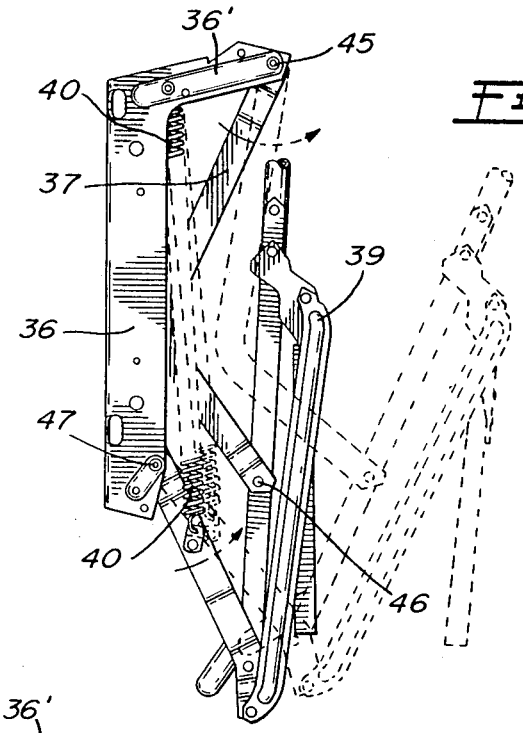
FIGS. 12 and 13 are side elevations of the front section and the mounting means showing how the former is folded vertically adjacent the mounting means.
Figure 13:
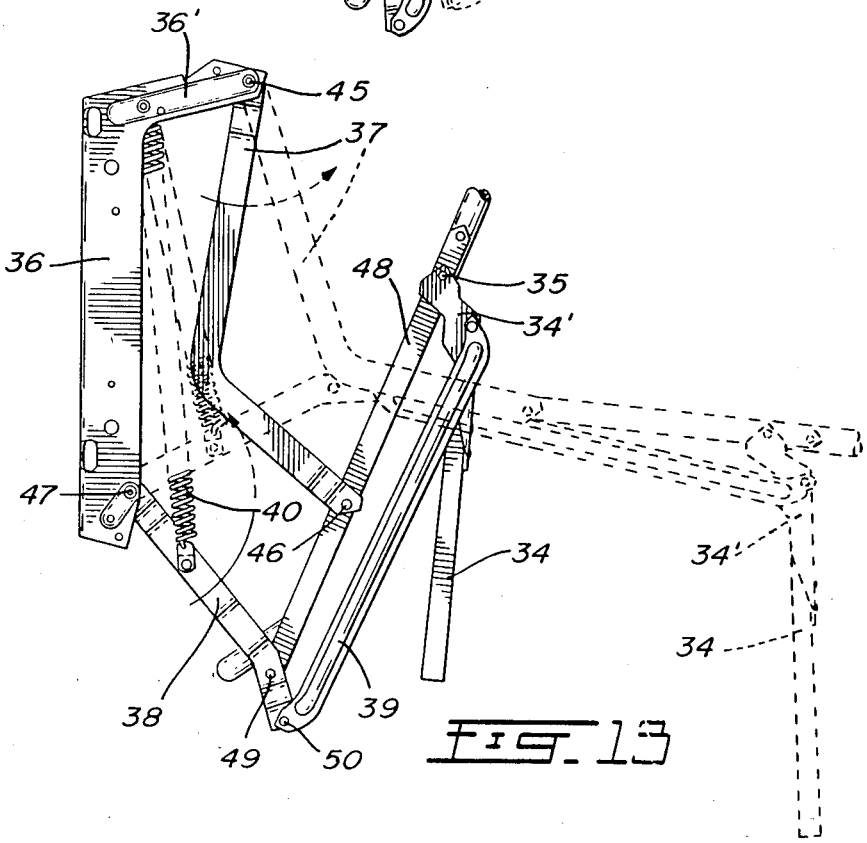

Referring now to FIGS. 6 and 7, it is clearly shown that the front end of rear section 11 and the rear end of middle section 12 extend slightly into each link 14 beyond their respective points of pivotal attachment. Thus, when the frame is in horizontal sleeping configuration, the front end and rear end of both sections 11 and 12 respectively will abut upwardly against the inner upper surface of the near portion of the corresponding link 14. Thus, the two sections 11 and 12 are effectively maintained in rigid horizontal configuration, i.e. there is no possibility of the two sections 11 and 12 pivoting upwardly relative to each other and their links 14. This construction embodies the rigidity means for the juncture of sections 11 and 12 (the rear juncture).

Rear section 11 is supported over a floor by a pair of legs 16 which are pivotally secured at their upper ends to the sides of section 11 intermediate the ends thereof at 23. Preferably, the two legs 16 are joined together at their lower ends by a transverse member 16′ for increased stability.

Referring now more broadly to FIGS. 4 to 7 and FIG. 10, there is shown the folding means for the juncture of sections 11 and 12. The means is identical on both sides of the frame and comprises a brace 17 pivotally secured at 18 to the upper portion of leg 16 and having a short orthogonal ear 17′ at its opposite end. Ear 17′ is pivotally secured at its outer end to link 14 intermediate the ends of the latter at 19. A short bar 20 is pivoted at one end to section 12 at 21 slightly frontwardly of the latter pivotal attachment to link 14 and at its other end to the inner end of ear 17′ at 22.

Figure 3:
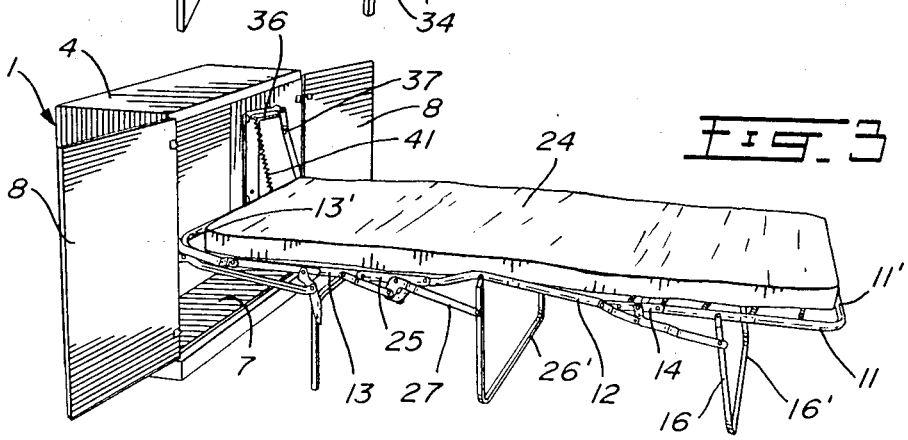
FIG. 3 is a third perspective view of the invention showing the bed in sleeping position.
Figure 4:
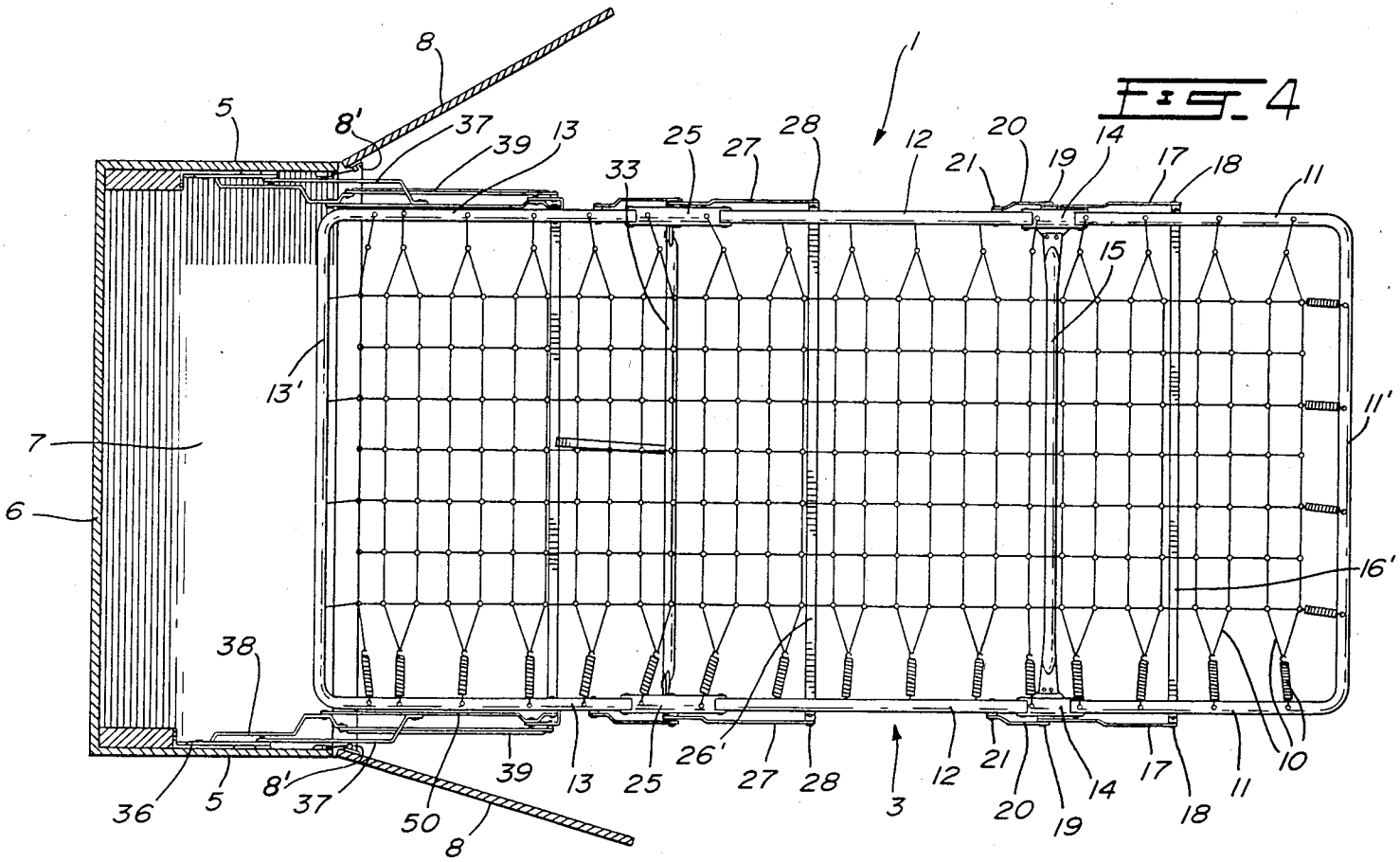
FIG. 4 is a top plan view of the bed in sleeping configuration without a mattress, also showing the console in plan section.

FIG. 3 shows the position of the above-described elements when frame 3 is horizontal and unfolded. Pivot points 14′, 19 and 18 described a first triangle which effectively resists any downward pressure exerted thereat by the weight of an occupant, thereby keeping frame 3 in sturdy horizontal position. Similarly, a second triangle formed by pivot points 21, 14″, and 22 serves the same function.

Figure 5:
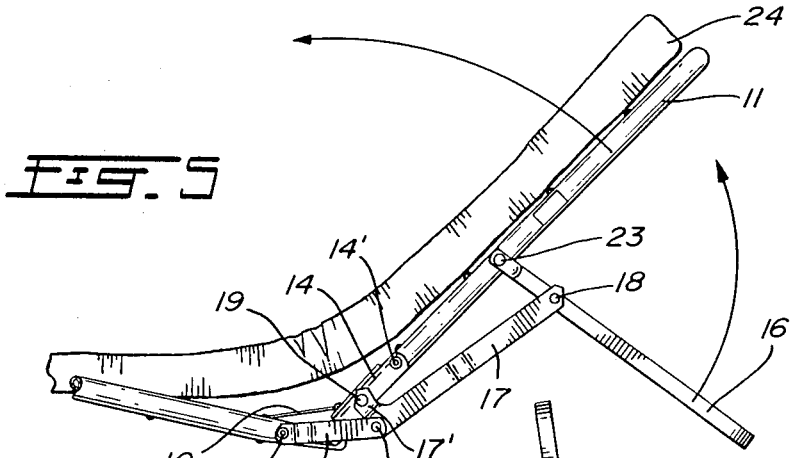
FIGS. 5 to 7 are side elevations of the end portion of the frame showing sequentially how the rear end section is folded.

FIGS. 5 to 7 illustrate how rear section 11 is collapsed, with the arrows indicating the direction of movement. FIG. 7 shows the rear section completely folded over section 12. In this position, pivot points 18 and 22 form a straight line with pivot point 23, being slightly upwardly spaced therefrom in the closed configuration of FIG. 7. Thus, a toggle assembly is formed, which constitutes a first locking means for the folded position of rear section 11. This locking means is rigid enough to withstand upward pressure exerted by a folded mattress 24, yet can be easily released by pulling upwardly on transverse member 16′.

Similarly, middle section 12 is adapted to be folded upwardly and then frontwardly over front section 13. Referring now to FIGS. 2 to 4 and FIGS. 8 to 11, it will be readily perceived that the second folding means for the junctures of the front and middle sections of frame 3 are, in fact, identical to the above-described first folding means, except for minor modifications. The front and middle sections are joined at either side by second link members 25, the latter being slightly longer and more sturdy than link members 14 to carry the greater weight of a body lying on that portion of the frame. Links 25 are otherwise identical to links 14 and are pivotally secured at 25′ and 25″ to the rear end of section 13 and the front end of section 12, respectively. The rear end of section 13 and the front end of section 12 extend beyond pivots 25′ and 25″, as in the first folding means, again constituting a second rigidity means for the associated juncture.

Similarly, a pair of transversely-aligned legs 26 are pivotally secured at their upper ends to either side of frame 3 at 26″, legs 26 being located intermediate the ends of section 12, preferably closer to the front end of the latter. Legs 26 are joined at their lower ends by a rigid transverse member 26′.

Brace 27 is also identical to brace 17, except that ear 27′ is inverted, which brace 27 is pivoted at 28 to leg 26 at one end and at its opposite end to link 25 centrally thereof at 31. The outer end of ear 27′ is pivotally attached at 29 to a second tie bar 30, which is slightly longer than the first tie bar 20. The opposite end of tie bar 30 is pivoted to front section 13 forwardly of the corresponding link member 25 at 32.

Preferably, the outer ends of both braces 27 are joined transversely by a vertically-downwardly-spaced second rigid cross-member 33. The latter is downwardly spaced from lattice 10 to provide room for depression of lattice 10 when a sleeper is on the frame.

Thus, the two triangles formed by pivot points 31, 25″, and 28 and by pivot points 32, 25′ and 29 keep the juncture stable in horizontal position as for the first juncture, while the second locking means for the juncture of the front and middle frames is embodied by pivots 28, 26″, and 29. (cf. dashed line in FIG. 9)

Referring now to FIGS. 8, 9, 12, and 13, the front portion of frame 3 is shown. Front section 13 is supported by a third pair of legs 34. Legs 34 include an upper segment 34′ pivotally secured to section 13 at 35. Preferably, legs 34 are an integral inverted U secured at either side to segments 34′ by bolts or the like.

The mounting means for frame 3 include mounting bracket 36 secured to the inner surface of either side wall 5. Each bracket 36 has an outwardly-extending upper arm 36′. Pivotally secured to the end of arm 36 at 45 and to an elongated member 48 parallel to front section 13, intermediate the ends of the latter at 46, is a first L-shape frame support 37 on either side of the frame.

The lower end of bracket 36 has pivotally secured thereto at 47 a second frame support 38 having a slightly downwardly-bent rear end. A stabilizing strut 39 is pivotally secured to the last-named rear end at 50 and also to segment 34′. The elongated carrying member 48 is pivoted to the end of section 13 and to strut 38 at the elbow of support 38, indicated by numeral 49.

Preferably, each of the two mounting assemblies, or either side of the frame, are further equipped with a biasing tension spring 40 pivotally fixed to the upper portion of bracket 36 and to frame support 38 near the front end of the latter. The springs 40 assist the user when folding the frame and mattress (if the latter is kept on the frame). Thus, frame 3 is easily folded uprightly in the console. Unfolding of the frame is counteracted by tension of springs 40.

To maintain frame 3 in such upright position, another toggle is defined by pivot points 49 and 45, the middle pivot being located at 46. The toggle embodies an upright lock means.

What I claim is:

1. A console bed comprising an upright console being of a general closed-box shape and having side walls and at least one door adapted to open outwardly; a collapsible bed foldable into said console in upright configuration from a rearmost horizontal extended position, outwardly of said console; said collapsible bed including a rectangular frame having a front end adjacent said console and an opposite rear end; said frame formed of three sections, a front section, a middle section and a rear section longitudinally connected to one another and defining a front and a rear junctures at either end of said middle section, folding means at the junctures of said sections, said middle and rear sections being foldable upwardly and then frontwardly to assure overlying relationship with said front section in folded configuration; first lock means to releasably keep said rear and middle sections in said overlying relationship; mounting means to pivotally mount said front section in said console; further including second lock means to releasably secure said frame in upright folded configuration in said console; pairs of transversely-aligned legs to support said frame; said folding means at both said front and rear junctions including, indentically on either side of the frame and at each of said junctures:

(a) a link member having an inverted U-shape profile and pivotally secured inwardly of its opposite ends to the adjacent ends of said sections;

(b) a leg pivotally secured about a first pivot at its upper end to the side of each section intermediate the ends thereof;

(c) a brace pivotally attached about a second pivot to the upper portion of each said leg at one end and having an orthogonal ear at its other end; said ear being pivotally secured to said link member intermediate the ends thereof;

(d) a tie bar having one end pivotally secured to one of said sections which is frontwardly of said link member, and its other end pivotally secured about a third pivot to said orthogonal ear, said first lock means being embodied by a toggle defined by said first, second and third pivot points; and legs arranged in pairs transversely of said frame, the lower ends of the legs of each pair being joined by a rigid transverse member, and wherein said mounting means comprises on each side of said frame: a mounting bracket secured to the inner surface of a side wall of said console and having a rearwardly-extending upper arm; a leg pivotally secured at its upper end to said front section on one side thereof; an elongated member extending in close parallel relationship along said one side of said front section, being secured thereto; a first L-shape frame support having one end pivotally secured to said upper arm and its other end pivoted to said elongated member intermediate the ends thereof; a second frame support having a slightly downwardly-bent rear end and an opposite front end pivoted to the lower end of said bracket; a stabilizing strut pivoted to said bent rear end and to the upper portion of said leg, wherein the elbow of said bent rear end is pivoted to the front end of said elongated member; and a biasing tension spring fixed to the upper portion of said bracket and to said second frame support adjacent the front end of the latter.

2. A console bed as defined in claim 1, wherein said second lock means is a toggle defined by a fourth pivot point between said elongated member and said second frame support; a fifth pivot point between said upper arm and said L-shape frame support and a sixth intermediate pivot point between said L-shape support and said elongated member.

3. A console bed as defined in claim 2 wherein each side of said middle section has a raised apex to keep a mattress on said frame from lateral displacement.

4. A console bed as defined in claim 2 wherein said link members are arranged in pairs transversely of said frame and the link members of each pair are joined by a rigid transverse crosspiece, the cross-piece at said front juncture being downwardly spaced from said frame.

5. A console bed comprising an upright console being of a general closed-box shape and having side walls and an open end; a collapsible bed foldable into said console in upright hanging configuration; said collapsible bed including a rectangular frame formed of at least two sections, a front section and a rear section; both said sections being longitudinally connected to each other, mounting means to interconnected said frame to said console, said mounting means including bracket means fixedly secured to the upper portion of the inner face of the side walls of said console, and connectors interconnecting said front section to said bracket means, said connectors including displacement means for limited sweeping displacement of said front section through said console open end from an upright hanging folded position, inside said console, to a horizontal extended position, outwardly of said console; folding means at the juncture of said sections to fold said second section into overlying relationship with said front section; first lock means to releasably keep said rear section in said overlying relationship; second lock means to releasably secure said frame in upright folded configuration in said console and at least one pair of transverselyaligned legs to support said frame in said horizontal extended position.

6. A console bed as defined in claim 5, further including biasing means interconnecting said bracket means and said connectors and acting in tension for assisting the folding of said frame.

7. A console bed as defined in claim 6, wherein said mounting means comprises on each side of said frame: a mounting bracket secured to the inner surface of a side wall of said console and having a rearwardly-extending upper arm; a leg pivotally secured at its upper end to said front section on one side thereof; an elongated member extending in close parallel relationship along said one side of said front section, being secured thereto; a first L-shape frame support having one end pivotally secured to said upper arm and its other end pivoted to said elongated member intermediate the ends thereof; a second frame support having a slightly downwardly-bent rear end and an opposite front end pivoted to the lower end of said bracket; a stabilizing strut pivoted to said bent rear end and to the upper portion of said leg, wherein the elbow of said bent rear end is pivoted to the front end of said elongated member; and a biasing tension spring fixed to the upper portion of said bracket and to said second frame support adjacent the front end of the latter.

8. A console bed as defined in claim 7, wherein said second lock means is a toggle defined by a first pivot point between said elongated member and said second frame support member; a second pivot point between said upper arm and said L-shaped frame support and a third intermediate pivot point between said L-shape support and said elongated member.

* * * * *